US006283383B1

(12) United States Patent
Blank et al.

(10) Patent No.: US 6,283,383 B1
(45) Date of Patent: Sep. 4, 2001

(54) RAIL SYSTEM

(75) Inventors: Helmuth Blank, Seevetal; Bernd Pahl, Hamburg, both of (DE)

(73) Assignee: Phoenix Aktiengesellschaft, Hamburg (DE)

( * ) Notice: Subject to any disclaimer, the term of this patent is extended or adjusted under 35 U.S.C. 154(b) by 0 days.

(21) Appl. No.: 09/485,567

(22) PCT Filed: Sep. 2, 1998

(86) PCT No.: PCT/DE98/02570

§ 371 Date: Feb. 11, 2000

§ 102(e) Date: Feb. 11, 2000

(87) PCT Pub. No.: WO99/16976

PCT Pub. Date: Apr. 8, 1999

(30) Foreign Application Priority Data

Sep. 26, 1997 (DE) ..... 197 42 544

(51) Int. Cl.[7] ..... E01B 19/00
(52) U.S. Cl. ..... 238/382; 238/109; 238/115
(58) Field of Search ..... 238/2, 29, 83, 238/84, 115, 103, 107, 382

(56) References Cited

U.S. PATENT DOCUMENTS 5,165,598 * 11/1992 Ortwein ..... 238/382
5,312,038 * 5/1994 Merlanti et al. ..... 238/382
5,551,631 * 9/1996 Cailliau ..... 238/382
5,725,149 * 3/1998 Goossens ..... 238/382

FOREIGN PATENT DOCUMENTS 27 51 346 5/1979 (DE) .
39 35 354 4/1991 (DE) .
43 33 243 4/1995 (DE) .
43 35 516 4/1995 (DE) .
0 672 789 9/1995 (EP) .
0 751 257 1/1997 (EP) .
0 795 645 9/1997 (EP) .
2 137 267 10/1984 (GB) .
WO82 02225 7/1982 (WO) .

* cited by examiner

*Primary Examiner*—Mark T. Le
(74) *Attorney, Agent, or Firm*—Collard & Roe, P.C.

(57) ABSTRACT

The invention relates to a rail system (1) comprising a line of rails with fixations, cross ties (wood, concrete, etc.), an infrastructure (2) on which the cross ties are laid, as well as an elastomeric cross tie shoe, whose sidewall (7), which tapers upward, entirely or partially surrounds the cross tie, the inner sidewall being in the form of a flexible lip (9) sealingly laid against said cross tie (2); besides, between the bottom of the cross tie shoe (13) and the cross tie underside (2) is inserted an elastic intermediate layer (5). The rail system according to the invention (1) is characterized in that the sidewall (7) of the cross tie shoe (4) presents on its inner face (8) a pattern of ribs and grooves and that the elastic intermediate layer (5) is provided with extruded-like channels (6, 6', 6") located virtually in the same plane as that in which two geometries of alternating channels appear.

13 Claims, 2 Drawing Sheets

RAIL SYSTEM

This is a 371 of PCT/DE98/02570 filed on Sep. 2, 1998, which is based on German No. 19742544.5, filed on Sep. 26, 1997.

BACKGROUND OF THE INVENTION

1. Field of the Invention

The invention relates to a rail system consisting of the following:

A line of rails with securing means;

crossties made of wood, concrete or the like;

a substructure (ballast of broken stone; solid bed), on which the crossties are supported; as well as a crosstie shoe made of elastomeric material (i.e., rubber or a plastic similar to rubber), the sidewall of which is becoming wider upwardly and wholly or partially surrounding the crosstie, whereby the sidewall ends on its inner side in the form of a flexible lip sealingly abutting the crosstie, and has a nose with a substantially rectangular cross section and preferably located on the outer side of said sidewall within its upper zone; and whereby, furthermore, an elastic intermediate layer is present between the crosstie shoe and the underside of the crosstie.

2. The Prior Art

Based on the prior art outlined above, which is described in greater detail in German laid-open patent specification 43 35 516 A1, the problem is to provide a rail system with with crosstie shoes in which both horizontal rigidity and vertical shock absorption are assured in an optimal way primarily in view or the type of construction of solid beds, which is increasingly becoming more important.

SUMMARY OF THE INVENTION

Now, said problem is solved in that the sidewall of the crosstie shoe has a system of ribs and grooves on its inner side; and the elastic intermediate layer is provided with channels extending in the form of strands substantially disposed in one plane, whereby two geometries of channels appear, which are arranged alternating with each other.

BRIEF DESCRIPTION OF THE DRAWINGS

Now, the invention is explained with the help of an exemplified embodiment and by reference to the schematic drawings, in which.

DETAILED DESCRIPTION OF THE PREFERRED EMBODIMENT

Figure 1:
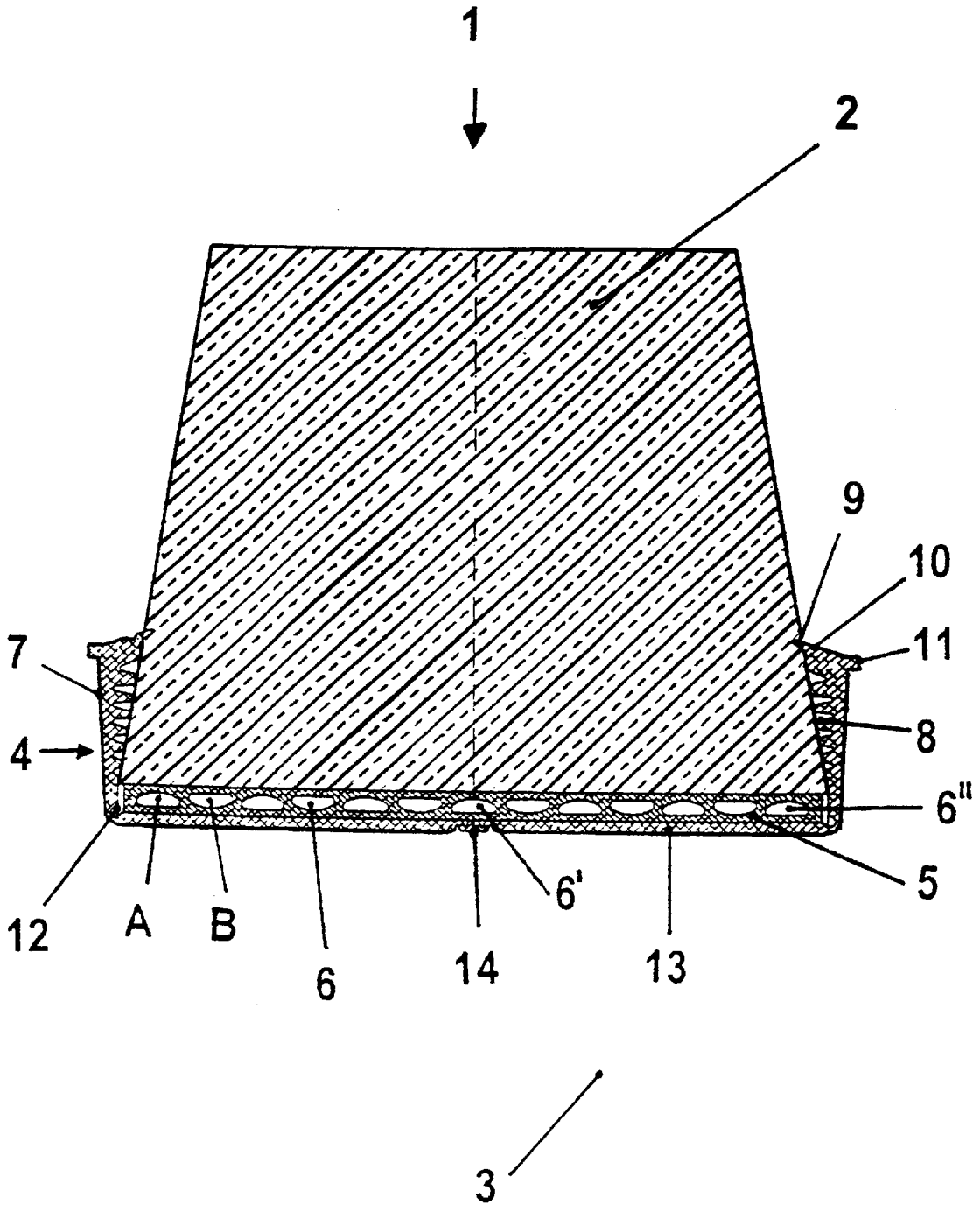
FIG. 1 shows a cross section through a crosstie and a crosstie shoe.

According to FIG. 1, the crosstie shoe 4 has a sidewall 7, which becomes wider in the upward direction, forming a substantially triangular cross sectional shape. In this connection, the sidewall surrounds the crossties only partially in the present case, i.e., within the lower zone of the crosstie.

On its inner side, sidewall 7 ends in the form of a flexible lip 9, which is sealingly abutting crosstie 2. For the purpose of increasing the elasticity, said lip has a notching 10 on the outer side. Owing to said design measures with respect to lip 9, the penetration of concrete between crosstie shoe, and crosstie 2 is excluded to the greatest possible extent within the framework of the solid bed during concreting of the latter.

Furthermore, on its outer side, namely within the upper zone, sidewall 7 has a nose 11, which is substantially rectangular viewed in the cross section. Said nose indicates the height of the level of the concrete of the solid bed.

In addition, on its inner side, sidewall 7 has a rib-groove system 8 preferably having at least five grooves, said system assuring horizontal rigidity.

Crosstie shoe 4 has an inside notching 12 located in the corner zone between bottom 13 of the crosstie shoe and sidewall 7. Said notching provides the shoe of the crosstie with increased flexibility. In addition, in its center, the bottom 13 of the crosstie shoe is provided with an expansion fold, which is explained in greater detail in the following in association with FIG. 2.

The elastic intermediate layer 5, which like shoe 4 of the crosstie is made of elastomeric material, is provided with the channels 6, 6' and 6" extending in the form of an extruded strand, said channels being substantially disposed in the same plane, whereby two geometries A and B of the channels appear. The channels have a substantially semicircular, semioval or hemi-ellipsoidal cross-sectional shape (in the unstressed state), whereby the flattened and the curved sides of the channels point upwardly and downwardly in an alternating way. Number "n" of the channels is an uneven number (n=13). Furthermore, the flattened sides of channel 6', which is arranged in the center, like also the ones of the two channels 6", point downwardly in the marginal zone of elastic intermediate layer 5. Through said measures, elastic intermediate layer 5 provides for vertical shock absorption.

The following material parameters usefully apply to crosstie shoe 4 and elastic intermediate layer 5:

| | |
|---|---|
| Crosstie shoe | SBR/BR mixture<br>Shore hardness A:<br>63 ± 5 |
| Elastic intermediate layer | EPDM<br>Shore hardness A:<br>38 ± 5 |

The abbreviations stand for:

SBR=styrene-butadiene rubber

BR=butadiene rubber

EPDM=ethylene propylene diene copolymer

Figure 2:
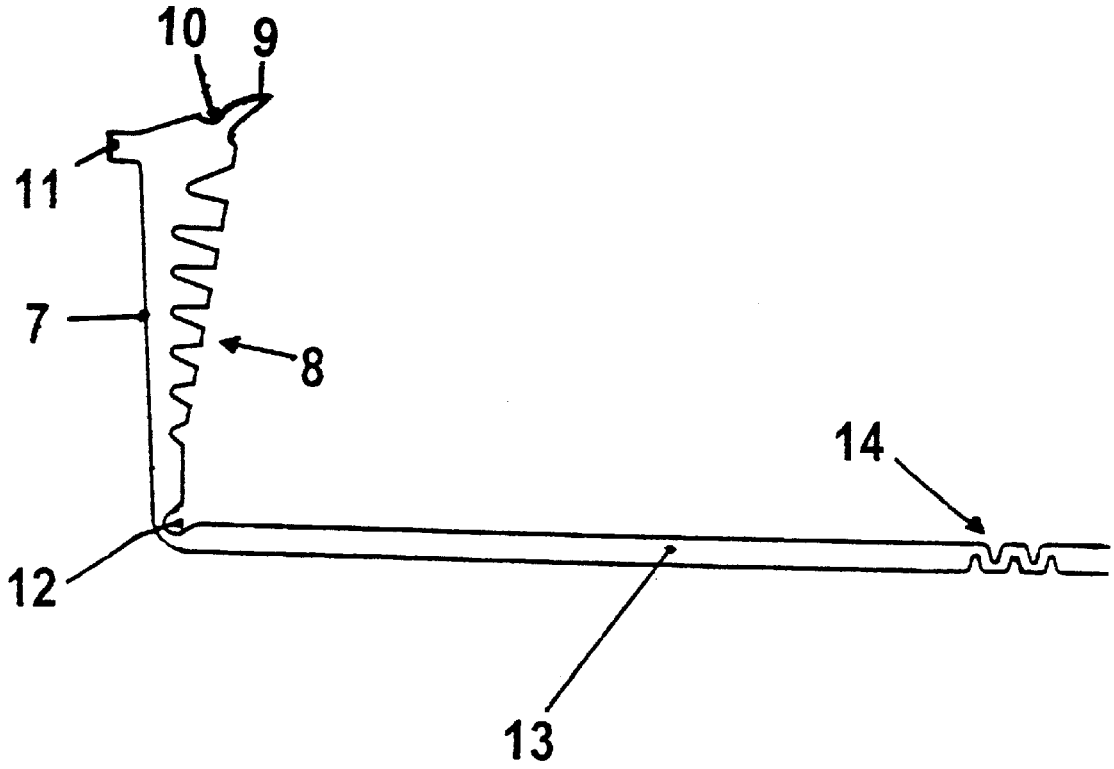
FIG. 2 shows an enlarged representation of the expansion fold.

FIG. 2 shows within the framework of an enlarged representation a crosstie shoe bottom 13 with an expansion fold 14, which is preferably formed by two to five folds. This measure assures easier deformation of crosstie shoe 4 in the vertical direction.

In addition, the special features of the construction of sidewall 7 are shown here again enlarged.

What is claimed is:

1. A rail system comprising:

a crosstie made from a material selected from the group consisting of wood and concrete;

a crosstie shoe made of elastomeric material, said shoe having a sidewall that widens in an upward direction and at least partially surrounds said crosstie, wherein an end of said shoe has and inner side and an outer side, said inner side having a flexible lip that sealingly abuts said crosstie and said outer side having a nose with a rectangular cross section, and wherein an inner side of said sidewall has a rib-groove system; and an elastic intermediate layer disposed between a bottom of said crosstie shoe and an underside of said crosstie, said elastic intermediate layer having channels extending in the form of a strand, said channels being disposed substantially in the same plane and having two alternating geometries.

2. The system according to claim 1, wherein the rib-groove system comprises at least five grooves.

3. The system according to claim 1, wherein the lip has a notch on at least one of the outer and inner side, for increasing elasticity.

4. The system according to claim 1, wherein the crosstie shoe has an inside notch in a corner between the bottom of the crosstie shoe and the sidewall.

5. The rail system according to claim 1, wherein the crosstie shoe bottom has an expansion fold in its center.

6. The rail system according to claim 5, wherein the expansion fold has between two and five folds.

7. The rail system according to claim 1, wherein the channels have a cross-sectional shape selected from the group consisting of semicircular, semioval and hemiellipsoidal, each channel having a flattened side and a curved side, and wherein the flattened and curved sides of the channels point alternatingly in the direction of the crosstie and in the direction of the bottom of the crosstie shoe.

8. The rail system according to claim 1, wherein there are an uneven number of channels.

9. The rail system according to claim 7, wherein the channels arranged in the center and at ends of the intermediate layer have flattened sides that point toward the bottom of the crosstie shoe.

10. The rail system according to claim 1, wherein the crosstie shoe consists of an SBR/BR mixture.

11. The rail system according to claim 1, wherein the elastic intermediate layer consists of EPDM.

12. The rail system according to claim 1, wherein the crosstie shoe has a Shore hardness A of 63±5.

13. The rail system according to claim 1, wherein the elastic intermediate layer has a Shore hardness A of 38±5.

* * * * *